US007361001B2

(12) United States Patent
Robert

(10) Patent No.: US 7,361,001 B2
(45) Date of Patent: Apr. 22, 2008

(54) HYDRAULIC VANE PUMP

(75) Inventor: Dominique Robert, Benfeld (FR)

(73) Assignee: General Motors Corporation, Detroit, MI (US)

( * ) Notice: Subject to any disclaimer, the term of this patent is extended or adjusted under 35 U.S.C. 154(b) by 494 days.

(21) Appl. No.: 11/032,789

(22) Filed: Jan. 11, 2005

(65) Prior Publication Data

US 2006/0153690 A1 Jul. 13, 2006

(51) Int. Cl.
*F01C 19/08* (2006.01)
*F04B 17/00* (2006.01)
*F04B 35/04* (2006.01)

(52) U.S. Cl. ..... 417/410.3; 418/131; 418/132

(58) Field of Classification Search ..... 418/180, 418/132, 259, 260, 261, 262, 263, 264, 265, 418/266, 267, 268, 269
See application file for complete search history.

(56) References Cited

U.S. PATENT DOCUMENTS

| | | | | |
|---|---|---|---|---|
| 4,256,443 | A * | 3/1981 | Kunze et al. | 418/77 |
| 4,386,891 | A * | 6/1983 | Riefel et al. | 418/81 |
| 4,470,765 | A * | 9/1984 | Hegler | 417/299 |
| 5,046,933 | A * | 9/1991 | Haga et al. | 418/78 |
| 6,030,191 | A * | 2/2000 | Wood et al. | 418/1 |
| 6,033,197 | A * | 3/2000 | Brown et al. | 418/180 |
| 6,152,716 | A * | 11/2000 | Agner | 418/132 |

* cited by examiner

*Primary Examiner*—Devon C. Kramer
*Assistant Examiner*—Patrick Hamo

(57) ABSTRACT

A hydraulic vane pump includes a plurality of members forming a recession and an orifice in fluid communication with one another and with rotating vane cells at an inlet sector of the pump. Air entrained in the vane cells is exhausted through the recession and the orifice prior to fluid passing from the inlet sector to a discharge sector, thereby increasing pump capacity and decreasing cavitation noise. A method of pumping fluid in a vane pump to decrease cavitation noise is also provided.

14 Claims, 4 Drawing Sheets

HYDRAULIC VANE PUMP

TECHNICAL FIELD

The invention relates to a hydraulic vane pump configured to vent entrained air from pumped fluid.

BACKGROUND OF THE INVENTION

Air entrained in fluid pumped by a hydraulic vane pump reduces pump capacity and may cause unwanted pump noise due to cavitation. Cavitation occurs when the entrained air collapses or implodes as it passes from a relatively low pressure region of a pump, such as a fluid inlet, to a relatively higher pressure region, such as a discharge or outlet region.

SUMMARY OF THE INVENTION

The invention comprises a hydraulic vane pump configured to vent entrained air from pumped fluid before the fluid passes to the discharge area, thereby increasing pump capacity and reducing unwanted cavitation noise. The pump includes a plurality of vanes circumferentially spaced about a rotor for rotation therewith. A plurality of members cooperate with the rotating vanes and rotor to define reciprocally expanding and contracting vane cells in a fluid inlet sector and a fluid discharge sector, respectively. The members may include a cam ring defining a generally oval cavity, the rotor and vanes being rotatable within the cavity.

The plurality of members defines an air flow path, including an orifice and a recession disposed at the inlet sector and in fluid communication with one another and the vane cells such that entrained air in the fluid is vented through the orifice to the recession before the fluid is transferred by the rotating vanes to the outlet sector. The air flow path thus creates a connection capacitance between the vane cells and the inlet sector to discharge entrained air. By discharging the entrained air at the inlet sector, pump capacity is increased because the volume of pumped fluid is not unnecessarily decreased by the volume of entrained air (i.e., pump capacity is maximized). By discharging the entrained air, pump cavitation noise is reduced or eliminated.

In one aspect of the invention, the recession and orifice are radially aligned so that entrained air is vented from one of the vane cells through the orifice to the recession as the vane cell rotates past the orifice.

In yet another aspect of the invention, the recession extends from the orifice toward the fluid inlet to form an air vent passage from the vented vane cell back to the fluid inlet.

In a further aspect of the invention, the plurality of members includes a pump housing disposed on one side of the rotor. The recession may be formed in the pump housing.

In yet another aspect of the invention, the plurality of members includes a thrust plate disposed on the same side of the rotor as the pump housing. The orifice may be formed in the thrust plate. The thrust plate may form both the fluid inlet and the fluid outlet.

In still a further aspect of the invention, the vane cells may define two inlet sectors, i.e., first and second inlet sectors, as well as first and second discharge sectors. First and second recessions and first and second orifices may be formed respectively at the first and second inlet sectors. By providing a recession that is in fluid communication with an orifice at each of the inlet sectors, pump capacity is further increased and cavitation noise further decreased.

A method of decreasing cavitation noise in a vane pump includes forming a recession in pump structure. The method further includes forming an orifice in other pump structure. The method further includes locating the recession and the orifice in fluid communication with one another and with rotating vane cells in an inlet sector of the vane pump between a fluid inlet and a fluid outlet. The method further includes providing fluid to the vane cells. The method further includes venting entrained air from the fluid through the orifice to the recession. After the exhausting step, the method includes discharging the fluid from the vane cells. Accordingly, entrained air is vented prior to discharging the fluid.

The method may include installing the vane pump on a vehicle for pumping fluid, such as transmission fluid. The vane pump may alternatively be used for pumping other fluids on the vehicle such as brake or steering fluids.

The above features and advantages and other features and advantages of the present invention are readily apparent from the following detailed description of the best mode for carrying out the invention when taken in connection with the accompanying drawings.

DESCRIPTION OF THE PREFERRED EMBODIMENT

Figure 1:
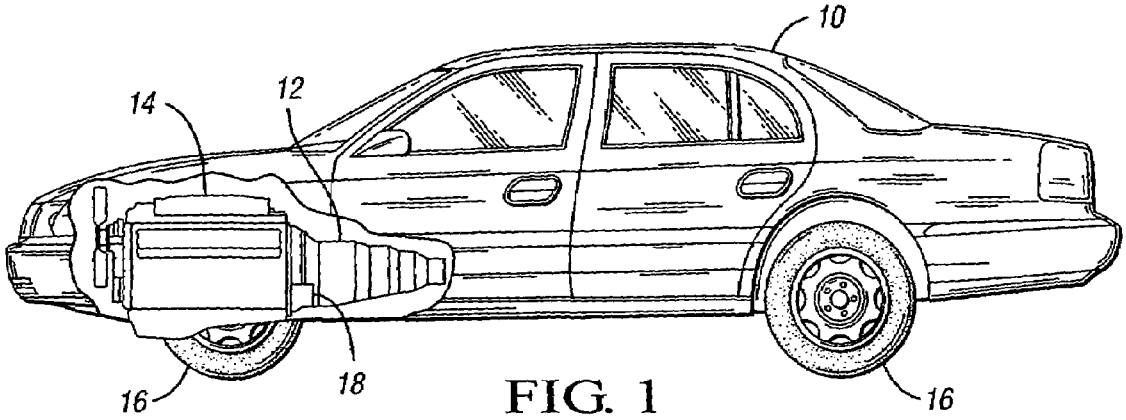
FIG. 1 is a schematic illustration of a vehicle having a transmission with a hydraulic vane pump for pumping fluid within the transmission.

Referring to the drawings, where like reference numbers refer to like components, FIG. 1 illustrates a vehicle 10 having a transmission 12 for transmitting power from a power plant 14, such as an engine, to wheels 16 as is well understood by those skilled in the art. A hydraulic vane pump 18 is mounted within or connected to the transmission 12 for pumping transmission fluid throughout the transmission 12.

Figure 2:
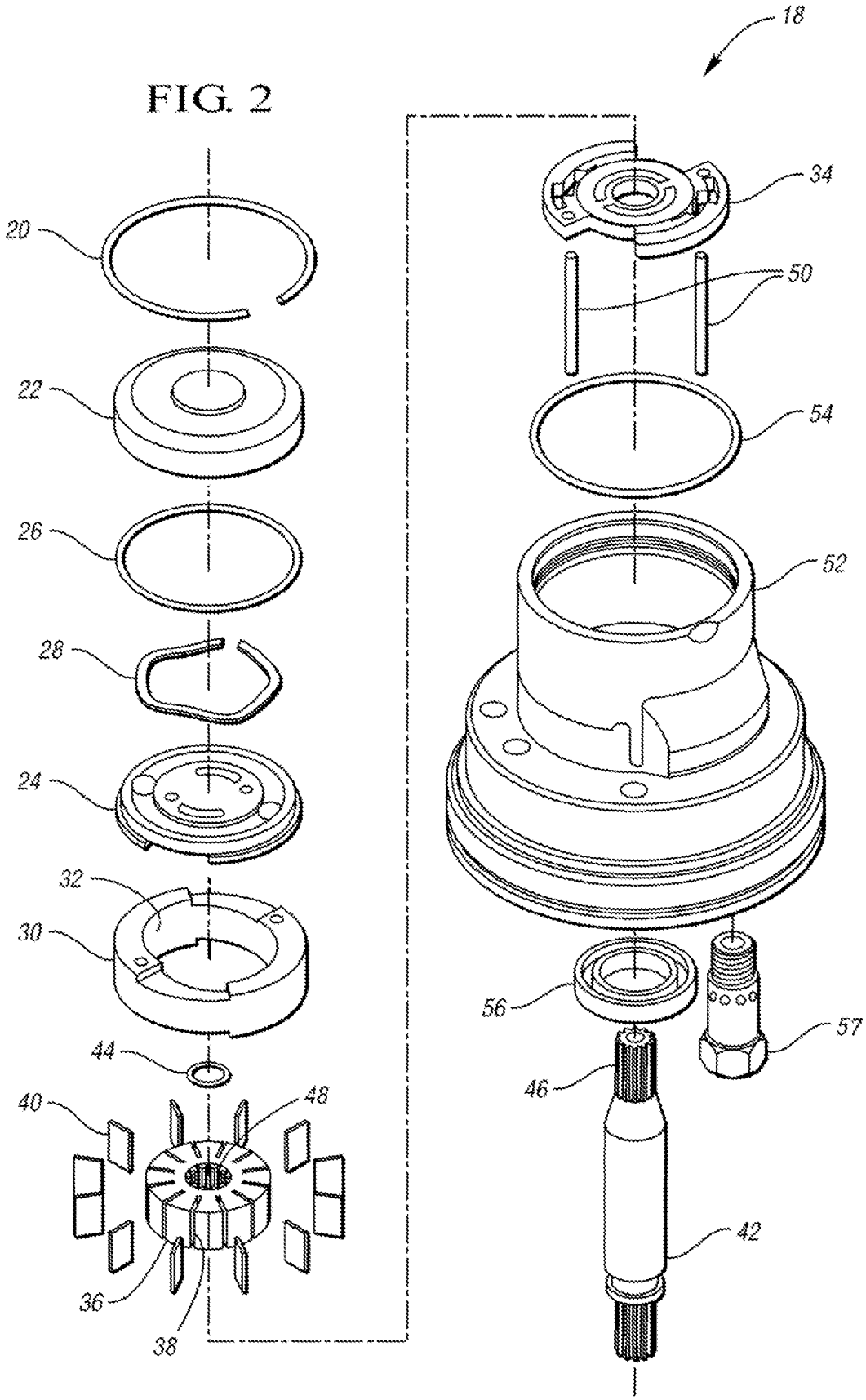
FIG. 2 is a schematic perspective illustration in exploded view of the hydraulic vane pump of FIG. 1.

Referring to FIG. 2, the hydraulic vane pump 18 is shown in greater detail. An end cover retaining ring 20 acts to retain a pump end cover 22 to a pressure plate 24. A pump end cover O-ring seal 26 as well as a pressure plate spring 28 are disposed between the pump end cover 22 and the pressure plate 24.

A cam ring 30 having a generally oval-shaped cavity 32 is disposed between the pressure plate 24 and a thrust plate 34. A pump rotor 36 forms a plurality of vane slots 38 circumferentially spaced about the rotor 36. A plurality of vanes 40 are received within the slots 38. The rotor 36 and vanes 40 are rotatable within the oval-shaped cavity 32 of the cam ring 30 between the abutting pressure plate 24 and thrust plate 34. A pump drive shaft 42 is connected to a source of power such as the power plant 14 or an electric motor and rotates to turn the rotor 36. A pump drive shaft retaining ring 44 helps to keep a toothed shaft 46 of the pump drive shaft 42 within a central annulus 48 of the rotor 36.

Cam ring dowel pins 50 secure the end cover 22, pressure plate 24, cam ring 30 and thrust plate 34 to a pump housing 52. A pump O-ring seal 54 is disposed between the assembled pressure plate 24 cam ring 30 and thrust plate 34 and the pump housing 52. A pump drive shaft seal 56 seals the drive shaft 42 within the pump housing 52. A pressure release valve assembly 57 is connected to the pump housing 52 and acts to relieve pressure when pressure within the pump 18 rises above a predetermined level.

Figure 3:
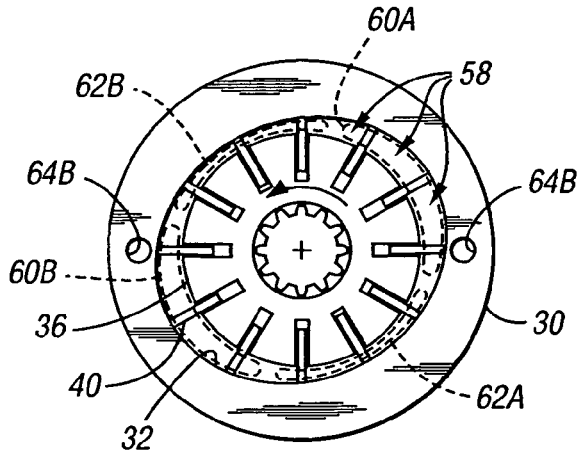
FIG. 3 is a schematic illustration in plan view of a rotor having a plurality of vanes rotating within an oval cavity formed by a cam ring in the hydraulic vane pump of FIGS. 1 and 2.

Referring now to FIG. 3, the cam ring 30 defines the oval-shaped cavity 32 in which the rotor 36 and plurality of vanes 40 rotate. The vanes 40 define a plurality of vane cells 58 (a vane cell being between each pair of adjacent vanes) that expand and contract as the vanes 40 rotate within the oval-shaped cavity. The expanding and contracting vane cells 58 create fluid inlet sectors 60A and 62B generally in the area of expanding vane cells, and fluid discharge sectors 62A and 62B generally in the area of the contracting vane cells. Dowel pin openings 64A, 64B are formed within the cam ring 34 for receiving the cam ring dowel pins 50 of FIG. 2.

Figure 4:
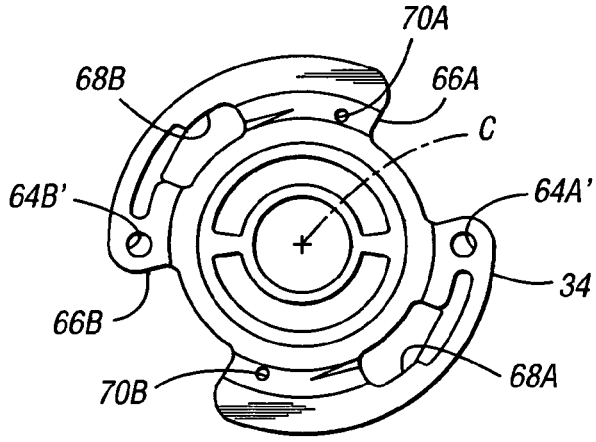
FIG. 4 is a schematic illustration in plan view of a thrust plate used in the hydraulic vane pump of FIGS. 1 and 2.
Figure 5:
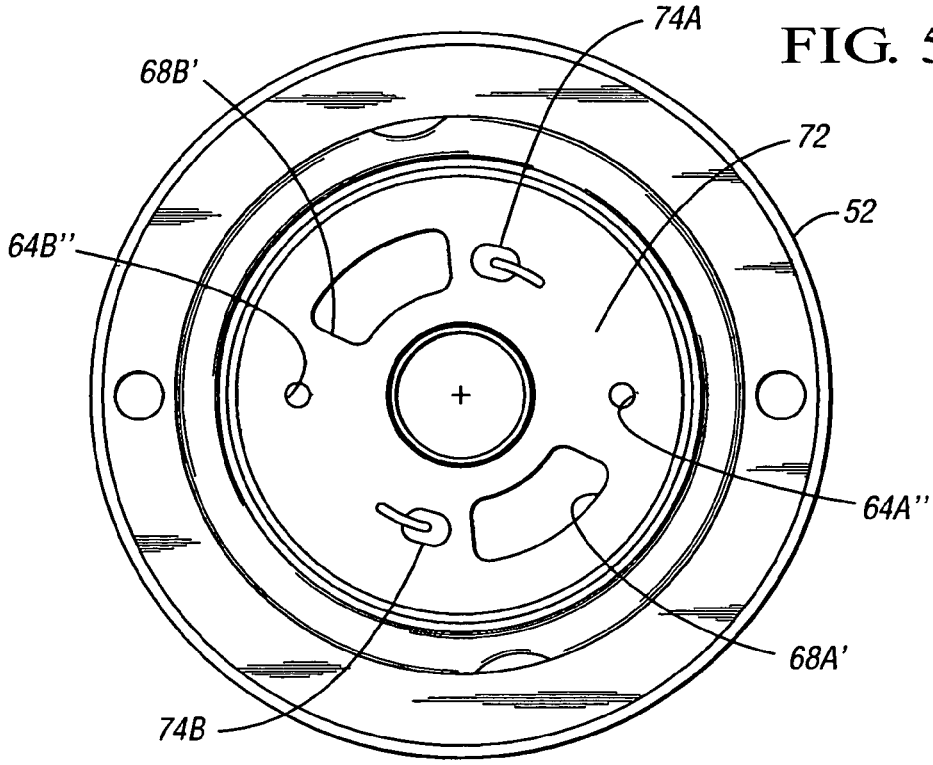
FIG. 5 is a schematic illustration in plan view of a pump housing of the hydraulic vane pump of FIGS. 1 and 2.

Referring to FIG. 4, the thrust plate 34 is formed with dowel pin openings 64A', 64B' alignable with the dowel pin openings 64A, 64B of FIG. 3, and dowel pin openings 64A", 64B" of the pump housing 52 of FIG. 5, with the thrust plate 34 positioned between the rotor 30 and the pump housing 52. The thrust plate 34 forms inlet notches 66A and 66B positioned at the inlet sectors 60A, 60B of FIG. 3, respectively, through which fluid is supplied to the vane cells from a pump sump (not shown). Discharge ports 68A, 68B are also formed in the thrust plate 34 and are positioned at the discharge sectors 62A, 62B, respectively. Importantly, two orifices 70A and 70B are formed in the thrust plate 34. The orifices are positioned relatively close to the inlet notches 66A, 66B. In a preferred embodiment, each of the orifices is 1.8 mm in diameter and is located radially 20.86 mm from the center C of the thrust plate 34. In this preferred embodiment, the center of each of the orifices 70A, 70B is displaced 72 degrees from the center of the respective dowel pin openings 64A', 64B'.

Referring now to FIG. 5, the pump housing 52 is shown with a generally planar inner surface 72 formed with two discharge ports 68A', 68B' generally alignable with the respective discharge ports 68A, 68B of FIG. 4.

Two recessions 74A, 74B are machined or otherwise formed into the inner surface 72. In a preferred embodiment, the recessions 74A, 74B are generally shaped with a main portion and an elongated tail portion extending therefrom (main portion 76A and tail portion 78A of recession 74A labeled in FIG. 6). The center of each of the main portions is angularly displaced from the respective dowel pin openings 64A", 64B" about 73 to 78 degrees so that the respective main portions abut the orifices 70A, 70B, when the thrust plate 34 is placed adjacent to the inner surface 72 of the pump housing 52 (as may be viewed with respect to orifice 70A and main portion 76A of recession 74A in FIG. 6) and the orifices 70A, 70B and recessions 74A, 74B are located at respective inlet sectors 60A, 60B. The elongated tail portions extend rearward from the main portions to be in fluid communication with the openings defined by the inlet notches 66A, 66B (i.e., the fluid inlets), as illustrated with tail portion 78A and inlet notch 66A in FIG. 6.

Figure 6:
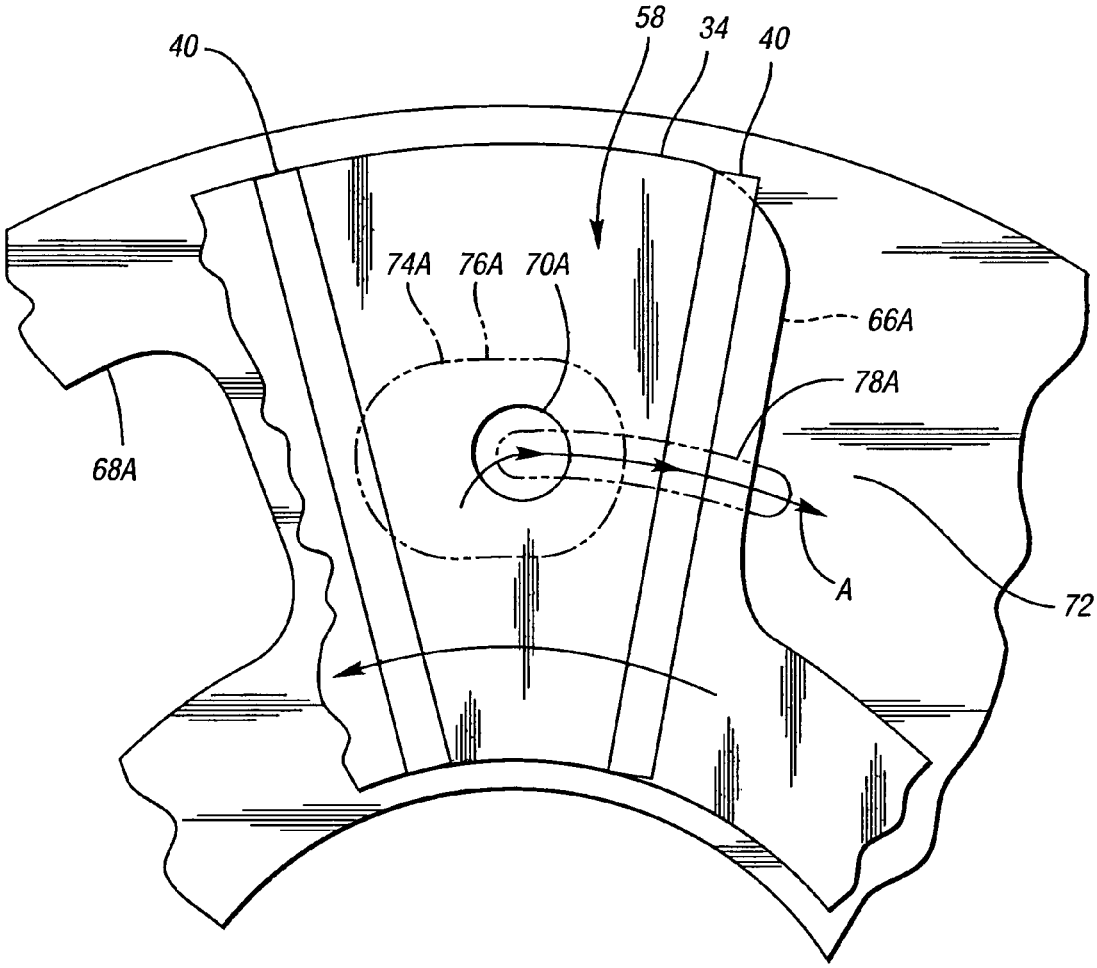
FIG. 6 is a schematic illustration in fragmentary plan view of the rotating vanes of FIG. 3 abutting the thrust plate of FIG. 4 and the pump housing of FIG. 5 to illustrate an air flow path.

Referring to FIG. 6, the orifice 70A is positioned in fluid communication with the recession 74A. As the vanes 40 rotate past the fluid inlet at the inlet notch 66A, air entrained within the fluid is vented through the orifice 70A to the main portion 76A of the recession 74A. The main portion 76A and the elongated tail portion 78A of recession 74A are shown in phantom. Because the elongated tail portion 78A of the recession 74A extends toward the fluid inlet at the notch 66A to establish fluid communication with the inlet, vented air in the recession 74A is expelled back to the inlet region. Thus, the vane cell 58 shown in FIG. 6 is generally free of entrained air before it moves to the discharge port 68A. More complete fluid compression is therefore possible as the vane cell 58 is further contracted in moving towards the discharge port 68A. Because entrained air is vented earlier in the compression process, cavitation noise is reduced. The arrow A in FIG. 6 denotes an air flow path including the orifice 70A and the recession 74A between the vane cell 58 and the inlet area at the inlet notch 66A.

Figure 7:
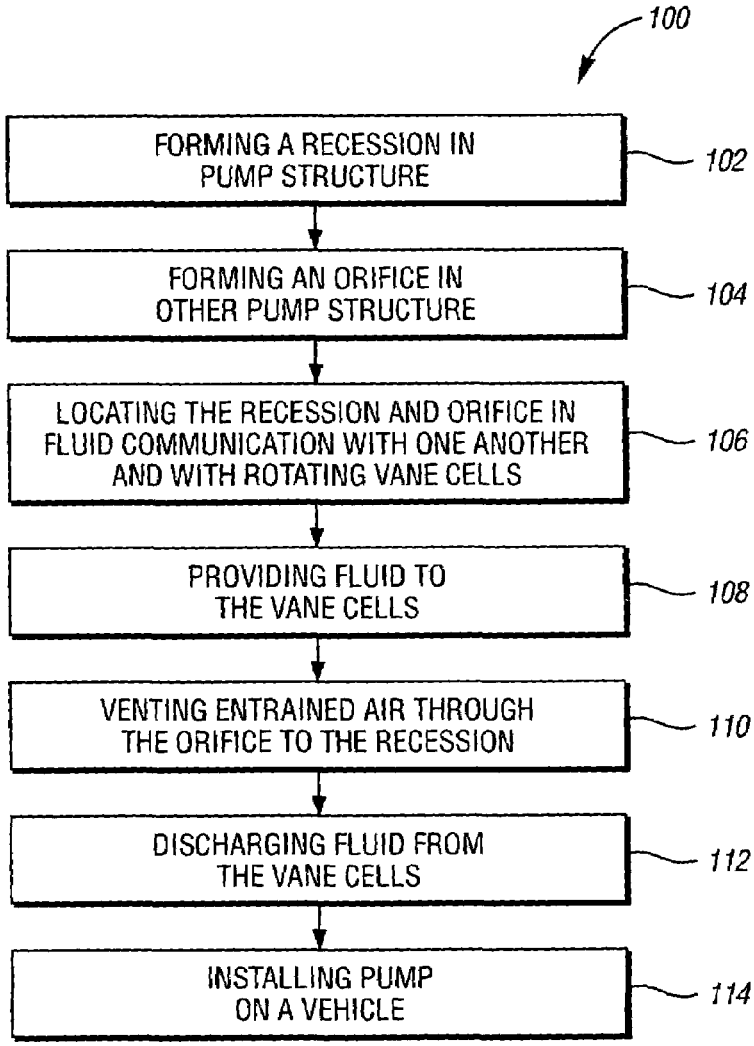
FIG. 7 is a flow diagram illustrating a method of decreasing cavitation noise in a vane pump.

Referring to FIG. 7, a method 100 of decreasing cavitation noise in the vane pump includes forming a recession in pump structure 102. The method 100 further includes forming an orifice in other pump structure 104. The method 100 further includes locating the recession and the orifice in fluid communication with one another and with vane cells in the vane pump at an inlet sector between a fluid inlet and a fluid outlet 106. The vane pump has reciprocally expanding and contracting vane cells in fluid communication with the fluid inlet and the fluid outlet, respectively. The method 100 further includes providing fluid to the vane cells 108. The method 100 further includes venting entrained air from the fluid through the orifice to the recession 110. The method 100 further includes, after the venting step 110, discharging the fluid from the contracting vane cells through the fluid outlet 112. Finally, the method 100 may further include installing the vane pump on a vehicle for pumping transmission or other fluid, such as brake or steering fluid 114.

While the best mode for carrying out the invention has been described in detail, those familiar with the art to which this invention relates will recognize various alternative designs and embodiments for practicing the invention within the scope of the appended claims.

The invention claimed is:

1. A hydraulic vane pump comprising:

a plurality of vanes circumferentially spaced about a rotor for rotation therewith;

a plurality of members cooperating with said plurality of vanes and said rotor to define reciprocally expanding and contracting vane cells in a fluid inlet sector and a fluid discharge sector, respectively, said expanding and contracting vane cells being operable to transfer fluid from a fluid inlet at said inlet sector to a fluid outlet at said discharge sector; and said plurality of members defining an air flow path including a recession and an orifice, said recession and orifice being disposed at said inlet sector and being in fluid communication with one another and with said vane cells such that entrained air in said fluid is vented from said vane cells via said air flow path prior to said fluid being transferred to said discharge sector, thereby increasing pump capacity and decreasing cavitation noise.

2. The hydraulic vane pump of claim 1, wherein said orifice and said recession are radially aligned such that entrained air is vented from a first of said vane cells through said orifice to said recession as said first of said vane cells rotates past said orifice.

3. The hydraulic vane pump of claim 2, wherein said recession extends from said orifice toward said fluid inlet to form an air vent passage from said first of said vane cells to said fluid inlet.

4. The hydraulic vane pump of claim 1, wherein said plurality of members includes a cam ring defining a generally oval cavity in which said rotor and vane cells rotate.

5. The hydraulic vane pump of claim 1, wherein said plurality of members includes a pump housing disposed on one side of said rotor.

6. The hydraulic vane pump of claim 5, wherein said recession is formed in said pump housing.

7. The hydraulic vane pump of claim 5, wherein said plurality of members includes a thrust plate disposed on said one side of said rotor between said vane cells and said pump housing.

8. The hydraulic vane pump of claim 7, wherein said orifice is formed in said thrust plate.

9. The hydraulic vane pump of claim 7, wherein said thrust plate at least partially forms said fluid inlet.

10. The hydraulic vane pump of claim 1, wherein said inlet sector is a first inlet sector, said vane cells further defining a second inlet sector and a second discharge sector;

wherein said recession is a first recession, said plurality of members further defining a second recession at said second inlet sector; and wherein said orifice is a first orifice, said plurality of members further defining a second orifice at said second inlet sector, said second orifice being in fluid communication with said second recession for discharging entrained air from said vane cells at said second inlet sector prior to said fluid being transferred to said second discharge sector, thereby further increasing pump capacity and decreasing cavitation noise.

11. A hydraulic vane pump comprising:

a plurality of vanes circumferentially spaced about a rotor, a plurality of members defining a generally oval cavity, said plurality of vanes being rotatable with said rotor within said cavity, adjacent vanes defining vane cells that reciprocally expand and contract as said rotor rotates to define an inlet sector and a discharge sector, respectively;

a pump housing disposed on one side of said rotor; and wherein the pump housing has a surface forming a recession;

a thrust plate forming a fluid inlet and a fluid outlet and being disposed on said one side of said rotor between said vane cells and said pump housing, said thrust plate forming an orifice generally radially aligned with said recession;

said fluid inlet and said fluid outlet being in fluid communication with said inlet sector and said outlet sector, respectively, said rotating vanes being operable to transfer fluid from said fluid inlet to said fluid outlet; and said recession and said orifice being disposed at said inlet sector and being in fluid communication with one another such that entrained air in said fluid is vented through said orifice to said recession and is exhausted from said recession to said fluid inlet, thereby increasing pump capacity and decreasing cavitation noise.

12. A method of decreasing cavitation noise in a vane pump, the method comprising:

forming a recession in pump structure;

forming an orifice in other pump structure;

locating said recession and said orifice in fluid communication with one another and with rotatable vane cells in an inlet sector of the vane pump between a fluid inlet and a fluid outlet;

providing fluid to said vane cells;

venting entrained air from said fluid through said orifice to said recession; and after said venting step, discharging said fluid from said vane cells.

13. The method of claim 10, wherein said recession extends toward said fluid inlet to form an air vent passage from a first of said vane cells through said orifice and recession to said fluid inlet.

14. The method of claim 10, further comprising:

after said locating and prior to said providing, installing said vane pump on a vehicle for pumping one of transmission fluid, brake fluid and steering fluid.

* * * * *